United States Patent [19]

Lamarque

[11] Patent Number: 4,852,828

[45] Date of Patent: Aug. 1, 1989

[54] DEVICE TO BRAKE THE UNFOLDING OF A FIN AND GUIDED MISSILE FITTED WITH A DEVICE OF THIS TYPE

[75] Inventor: Etienne Lamarque, Le Mesnil Saint Denis, France

[73] Assignee: Thomson-Brandt Armements, Boulogne Billancourt, France

[21] Appl. No.: 135,269

[22] Filed: Dec. 21, 1987

[30] Foreign Application Priority Data

Dec. 23, 1986 [FR] France ..... 86 18084

[51] Int. Cl.[4] ..... F27B 13/32; F27B 15/053

[52] U.S. Cl. ..... 244/3.29

[58] Field of Search ..... 244/3.27, 3.28, 3.29

[56] References Cited

U.S. PATENT DOCUMENTS 3,785,290 1/1974 Castor et al. .
3,819,132 6/1974 Rusbach ..... 244/3.28
4,143,838 3/1979 Holladay ..... 244/3.28
4,175,720 11/1979 Craig ..... 244/3.28
4,323,208 4/1982 Ball ..... 244/3.28

*Primary Examiner*—Deborah L. Kyle
*Assistant Examiner*—Richard W. Wendtland
*Attorney, Agent, or Firm*—Oblon, Fisher, Spivak, McClelland & Maier

[57] ABSTRACT

The device of the invention provides for the substantially constant unfolding of unfoldable fins on a guided missile without damaging the bearing structure or the fin itself. The device comprises a deformation part placed around a bearing neck that is joined to the fin. Means are used to convert the rotational kinetic energy due to the unfolding of the fin into translational energy. These means comprise, in particular, a compression ring which is displaced and compresses the deformation part in conjunction with the rotation of the bearing neck due to the unfolding of the fin. The invention can be used in missiles, self-propelled rockets and similar devices.

9 Claims, 2 Drawing Sheets

FIG_1A PRIOR ART
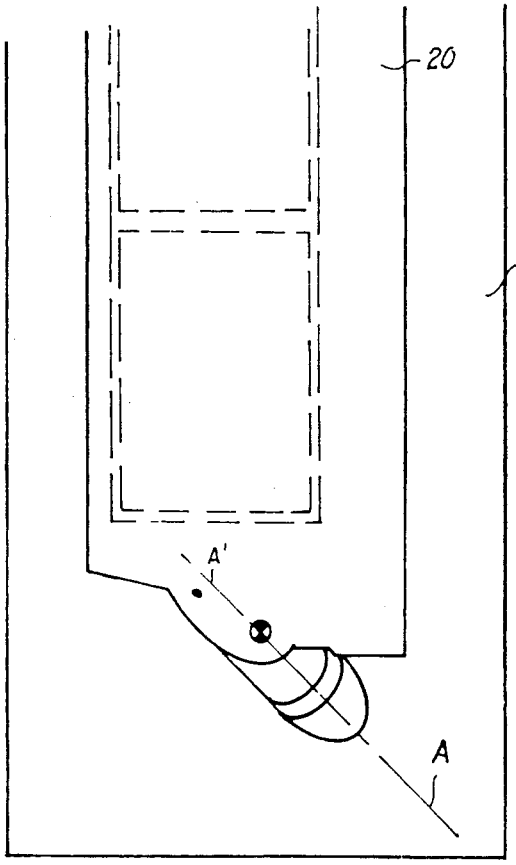
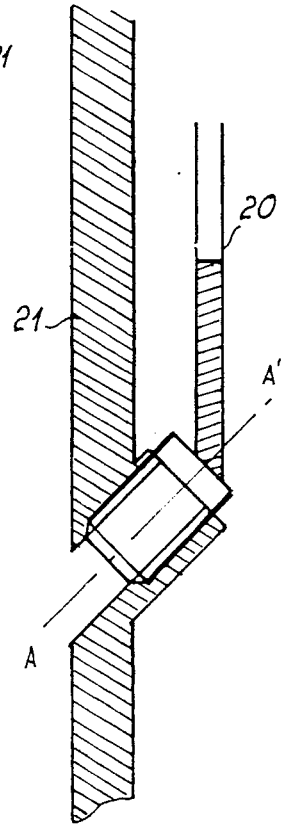
FIG_1B
PRIOR ART

DEVICE TO BRAKE THE UNFOLDING OF A FIN AND GUIDED MISSILE FITTED WITH A DEVICE OF THIS TYPE

BACKGROUND OF THE INVENTION

1. Field of the Invention

The invention pertains to unfolding fins, such as those used in missiles, self-propelled rockets and similar devices which we shall hereinafter call guided missiles, and pertains especially to a system to brake the unfolding of these fins.

2. Description of the Prior Art

In the prior art, there are known unfolding fins hinged on the body of the missile, on longitudinal axes, parallel to the longitudinal axis of the body. These fins are tangential to the body in the folded position and are located in radial axial planes in the active position.

Another prior art system is described in French patent No. 1 485 580, which is an improved vane unit for rockets, in which each fin is hinged on the body of the vane unit around an oblique orientating axis. The effect of this is that, when the fins are being unfolded, each of them passes from a folded position in which it is applied tangentially to the body of the vane unit, into an unfolded position, in which the fin is located in a radial axial plane.

This type of vane unit has a major disadvantage owing to the suddenness with which the fins are unfolded. This movement is provoked mechanically either by pistons or by pyrotechnical devices which tend to move the fins away from the body of the missile. Once these fins are moved away, the increase in the velocity of the missile at the moment of unfolding and the increase in the rotational velocity of the fins, due to the increase in the area of the fin that is being unfolded, makes the latter reach its unfolded position at considerable velocity and hence with energy sufficient to damage either the fin itself or the limit stop elements which hold it in this unfolded position.

The invention proposes to remove this disadvantage by proposing a system to brake the unfolding of the fin to prevent this sudden stop in the unfolded position and, hence, to prevent damage to a set of fins mounted on a guided missile.

furthermore, French patent No. 2448707 describes a set of fins for a missile where a fin may rotate on an axis tangential to the body of the missile on a rotating plate which can itself rotate around an axis transversal to the missile. This rotation is done by worm screws which transmit the rotational motion to the rotating plate while the fin rotates around the tangential axis. The fin is first applied to the surface of the missile, its axis being pointed tangentially and transversally to the longitudinal axis of the missile. When it is being straightened, the fin rotates in such a way that its axis is parallel to the longitudinal axis of the missile. In this assembly, there is provision for a braking mechanism that acts on the rotating plate to delay the rotational movement of the said plate and, consequently, the unfolding of the fin.

This device has a drawback in that it brings far too many moving mechanical parts (rotating plate, worm screw, etc.) into play.

SUMMARY OF THE INVENTION

The aim of the invention is to provide another simpler braking device that acts directly on the fin, and a guided missile fitted with a device of this type.

An object of the invention is a device to brake the unfolding, with respect to a body, of an unfoldable fin hinged on an axis which is fixed with respect to the said body, to achieve said unfolding by pivoting around said axis, a device comprising means to convert rotational kinetic energy into translational energy, said means comprising a screw thread and a deformation (i.e. shape-changing) part used firstly, to make the fin unfold at a substantially constant velocity and, secondly, to absorb a large part of the rotational kinetic energy of the unfolding of the fin.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 1A and 1B show a fin according to the prior art in a folded position as seen in two perpendicular views;

DESCRIPTION OF THE PREFERRED EMBODIMENTS

As and when an unfolding fin opens, the surface acted upon by the air current is increasingly great. This explains the increase in unfolding velocity and kinetic energy.

The invention comprises the use of a screw thread and a deformation part which, through their combined effects, make it possible regulate the unfolding velocity of the fin and absorb a maximum part of the kinetic energy due to this unfolding, the remaining energy being calibrated so as not to adversely change the geometry of the wing structure or the bearing structure.

Referring to FIGS. 1A and 1B, FIG. 1B being a cross-section view along the axis A—A', the unfolding of a fin of the prior art takes place as follows. The fin 20 is shown in its folded position against the body of the missile 21. It is shown pivoting with respect to the body, around an axis A—A' which is oblique to the longitudinal axis of the body, both with respect to the plane of the fin, i.e. along the plane of FIG. 1A, and with respect to the plane perpendicular to the plane of the fin, i.e. the plane of the FIG. 1B. The rotation of the fin 20 around this axis brings it to its unfolded position, namely it is still supported against the body of the missile 21 but its plane is perpendicular to the plane that it occupied in the folded position.

Figure 2:
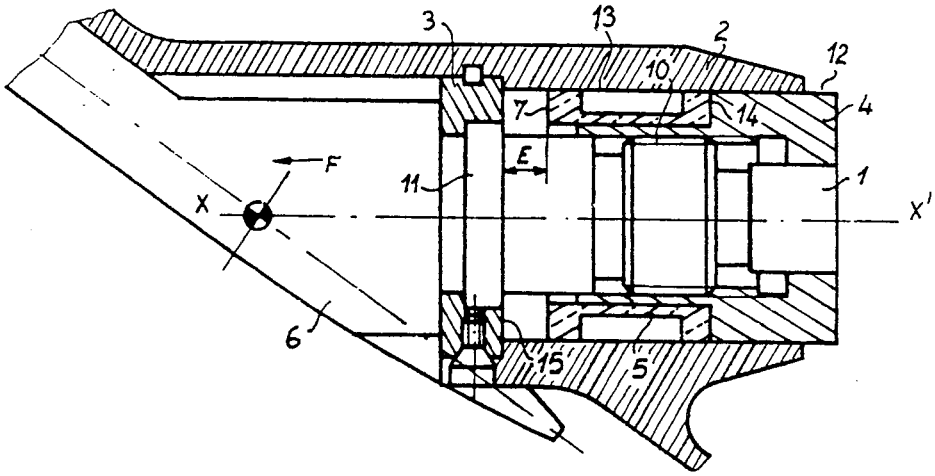
FIG. 2 shows a first embodiment of the device according to the invention.

Referring to FIG. 2, the fin 6 in the example has an oblique hinge, as described in the above paragraph, but is given a braking device according to the invention. This device comprises mainly means to convert rotational kinetic energy into translational energy. Said means, by the effect of the screw thread and of the deformation part, absorb a maximum part of the velocity and give the fin a smooth unfolding characteristic. To this end, the fin 6 forms one part with a bearing neck 1 which enables said fin to rotate with respect to the body of the missile. The bearing neck 1 is mounted so that it rotates on its X—X' axis which is fixed with respect to a body 2. The means to convert rotational kinetic energy into translational energy further comprise means to lock the bearing neck 1 in translation with respect to the body 2. These energy-converting means also comprise a ring 4 which is called a compression ring and is screwed into a thread 10 made on the outer diameter of the bearing neck 1. The energy-converting means also comprise means to lock this compression ring 4 in rotation with respect to the body 2. Finally, the energy-converting means comprise a translation limit stop member positioned round the bearing neck 1. The deformation part 5 is placed between this translation limit stop member and the compression ring 4. The length of this ring is smaller than the distance between the limit stop of a shoulder 14 of the compression ring 4, so that a lengthwise clearance E is left when the fin is in folded position.

To make a more precise reference to a concrete embodiment as shown in FIG. 2, the means to convert kinetic energy into translational energy is as follows. The bearing neck 1 is mounted so that it rotates around its axis X—X' by means of a bearing 3 joined to the body 2. The internal diameter of this bearing has, in fact, a recess corresponding to a shoulder 11 of the bearing neck 1 so that the latter is locked in translation with respect to the body 2, so that it does not move in the direction shown by the arrow F. A second bearing is formed by means of the compression ring 4 which is fixed in rotation with respect to the body 2. This compression ring is locked in rotation by two flattened surfaces (not shown) made on the external diameter 12 of the compression ring 4. This ring has a side face 14 against which the deformation part 5 is supported. In FIG. 2, this deformation part is shown in the form of a flattened U, but said part is not limited to this form.

The system works as follows. When the fin 6 is made to pivot around the axis X—X', it drives the bearing neck 1 which is joined to it. Owing to this rotation, and owing to the fact that the compression ring 4 is mounted so that it is screwed around this axis and locked in translation with respect to the body, said compression ring undergoes a translation motion inside the hole 13. The direction of the turn of the screw thread 10 of the bearing neck 1 and the internal tapping of the compression ring 4 are chosen so that the compression ring moves towards the first bearing 3, so as to compress the deformation part 5 between a radial surface 15 of the first bearing 3 and the radial surface 7 of the compression ring 4. For this translation to take place, it is also necessary to provide for a minimum clearance between the thread 10 and the internal tapping of the compression ring. Depending on the rotational angle of the fin, the tapping and the thread may comprise several turns thus giving the system greater mechanical strength and the compression ring greater translational movement.

The unfolding of the fin at a substantially constant velocity is possible only if an ancillary device gives it sufficient incidence at the start so that the air current makes it unfold. To do this, the fin must be in free rotation at the start of its unfolding before the braking stage. Depending on the specific example, this rotation may vary from 20 to 60 degrees. The deformation part 5 should therefore have a length such that, in the folded position of the fin, there remains a clearance E between the end 7, opposite to the compression ring 4, and the radial surface 15 of the block 3. This clearance E corresponds to the translation of the compression ring 4 during this free rotation stage.

The ancillary device for placing the fin at the proper incidence may be made by means of a piston actuated by gases generated by a charge placed on board the missile and fired by an electrical firing mechanism or a mechanical striking pin.

Figure 3A:
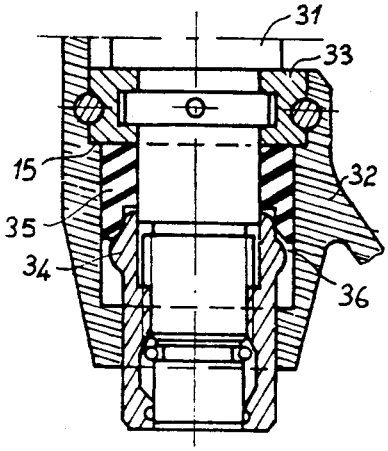
FIGS. 3A and 3B show a second embodiment of the device according to the invention.
Figure 3B:
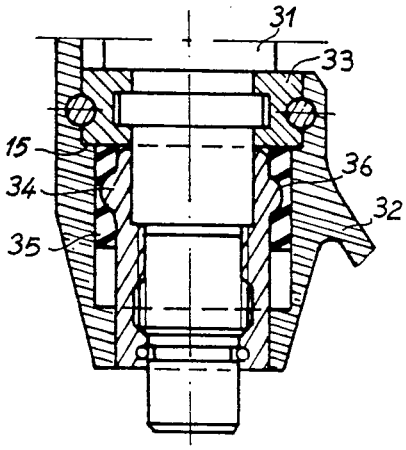

The deformation part 5 can absorb energy in many ways. The first way corresponds to the embodiment shown in Figure 2. In this case, this compression piece 4 has a tubular shape reinforced at its ends so that it represents a flattened U. When this part is compressed, its central part is buckled and the material of this central part partially filling the inside of the U. The materials used may be copper or aluminium or any relatively malleable or ductile alloys. With reference to FIGS. 3A and 3B, the compression ring 34 and the deformation part 35 have shapes different from those of the previous embodiment. The compression ring 34 is still free in translation and fixed in rotation so as to be displaced towards the deformation part 35. The deformation or change in shape as such does not take place in the same way because the deformation part, although it is still tubular, has a more compact shape, and its internal diameter is suited to axis 31. It is still supported on the radial surface 15 of the first bearing 33. However, the opposite end receives the action of the compression ring 34 which moves towards the deformation part 35. The longitudinal compression caused by the buckling of this latter part is no longer possible owing to the compactness of this part. Since there is a space 36 defined between the external diameter of the compression ring and the internal diamter of the body 32, the deformation part tends to fill this space by the fact that material is pushed back. The deformation part 35 may be made of a material with a viscosity that varies according to whether an elastomer or grease is used.

These embodiments are suited to application on guided missiles, the body 2 being the body of the missile.

Obviously, numerous modifications and variations of the present invention are possible in light of the above teachings. It is therefore to be understood that within the scope of the appended claims, the invention may be practiced otherwise than as specifically described herein.

What is claimed is:

1. A guided missile, which comprises;

a body;

at least one pair of unfolding fins mounted on said body; and a device for braking unfolding of said fins wherein said device comprises a device to brake the unfolding of said at least one pair of unfolding fins with respect to a body, said device being hinged on a bearing neck which is fixed with respect to said body, wherein said bearing neck is rotatable about an axis of said body so as to unfold said fins by rotation of said bearing neck about said axis, said device comprising:

a stop element positioned on said body; and means for converting rotational kinetic energy into translational energy, wherein said converting means comprises:

a screw thread formed on an outer surface of said bearing neck;

a compression ring screwed onto said screw thread; and a deformation part positioned around said bearing neck between said stop element positioned on said body and said compression ring such that said fins unfold at a substantially constant velocity and said converting means absorbs part of the rotational kinetic energy of said fins upon unfolding.

2. A device to brake the unfolding of a fin with respect to a body, said device being hinged on a bearing neck which is fixed with respect to said body, wherein said bearing neck is rotatable about an axis of said body so as to unfold said fin by rotation of said bearing neck about said axis, said device comprising:

a stop element positioned on said body; and means for converting rotational kinetic energy into translational energy, wherein said converting means comprises:

a screw thread formed on an outer surface of said bearing neck;

a compression ring screwed onto said screw thread; and a deformation part positioned around said bearing neck between said stop element positioned on said body and said compression ring such that said fin unfolds at a substantially constant velocity and said converting means absorbs part of the rotational kinetic energy of said fin upon unfolding.

3. A device according to claim wherein the deformation part is ring-shaped.

4. A device according to claim 3 wherein the converting means comprises: means for locking said bearing neck in translation with respect to the body; and which comprises means for locking said compression ring in rotation with respect to the body, and a translation limit stop member for the deformation part and which is positioned between said stop element and the compression ring so that it is compressed when said ring is displaced under the effect of the rotation of the bearing neck.

5. A device according to claim 4 wherein the means for locking the bearing neck in translation with respect to the body and the translation limit stop member comprise a bearing joined to the body and having a shoulder on which a shoulder portion of the bearing neck is supported, and wherein the means for locking said compression ring in rotation comprise flat surfaces formed on the bearing neck and on an internal diameter portion of the compression ring.

6. A device according to claim 4 wherein the deformation part has a tubular shape, reinforced at its ends, in the form of a flattened U, so as to change shape by buckling under the effect of the compression ring.

7. A device accordingly to claim 3 wherein the deformation part has a compact tubular shape, the compression ring having a shape such that a space is formed between said body and said compression spring to enable the deformation part to change shape.

8. A device according to claim 6 wherein the deformation comprises a malleable alloy.

9. A device according to claim 7 wherein the deformation comprises an elastomer.

* * * * *